United States Patent [19]

Chang

[11] 4,438,856

[45] Mar. 27, 1984

[54] COMBINATION BASE CUP AND BOTTLE

[75] Inventor: Long F. Chang, Sylvania, Ohio

[73] Assignee: Owens-Illinois, Inc., Toledo, Ohio

[21] Appl. No.: 336,000

[22] Filed: Dec. 30, 1981

[51] Int. Cl.[3] ..... B65D 23/08

[52] U.S. Cl. ..... 215/12 R; 215/1 C; 215/100 R; 220/69

[58] Field of Search ..... 215/1 R, 1 C, 12 R, 215/100 R; 220/69

[56] References Cited

U.S. PATENT DOCUMENTS

| | | | |
|---|---|---|---|
| 3,718,229 | 2/1973 | Wyeth et al. | 215/1 C |
| 3,927,782 | 12/1975 | Edwards | 215/12 R X |
| 4,138,026 | 2/1979 | Conklin | 215/12 R |
| 4,231,483 | 11/1980 | Dechenne et al. | 215/1 C X |
| 4,241,839 | 12/1980 | Alberghini | 150/12 R X |
| 4,293,359 | 10/1981 | Jakobsen | 215/12 R X |
| 4,326,638 | 4/1982 | Nickel et al. | 215/12 R |

*Primary Examiner*—William Price
*Assistant Examiner*—Sue A. Weaver
*Attorney, Agent, or Firm*—Thomas L. Farquer; M. E. Click

[57] ABSTRACT

A pressurized fluid package comprising an oriented plastic bottle having a generally cylindrical side wall, a neck terminating in a finish or a closure at the upper end, and a hemispherical bottom wall, and a base cup of plastic material. The base cup comprises a standing ring for engaging a support surface having a generally planar contacting surface. The base includes a support ring spaced above the standing ring and having an annular surface engaging the hemispherical bottom wall. The base has an annular frustoconical supporting member extending from the inner periphery of the standing ring and inclined upwardly and inwardly to the outer periphery of the supporting ring.

14 Claims, 8 Drawing Figures

COMBINATION BASE CUP AND BOTTLE

BACKGROUND AND SUMMARY OF THE INVENTION

A bottle generally consists of a shoulder portion with an opening, a side wall or main body which is generally cylindrical in shape, and a bottom joining the side wall. Because of the tendency of the wall of a pressurized plastic bottle to creep under internal pressure, it is a general practice to orient the plastic material and to design the bottle shape in such a way to improve resistance against creep. For the bottom section, it is known that if a uniform material distribution is achieved, the stress caused by the internal pressure can be minimized by using an outwardly hemispherical configuration. Molecular orientation can be obtained by blowing a properly designed parison in a blow mold in the orientation temperature region to enhance the strength of the bottle. The provision of a hemispherical configuration on the base wall of the pressurized plastic container provides for optimum resistance to internal pressure and optimum orientation during the blow molding process. This hemispherical configuration, requires a separate means of support to make the bottle stand upright. For this purpose, a base cup is normally used.

In one commonly used base cup, the base includes a toroidal standing ring for engaging the supporting surface, an annular support ring for engaging the hemispherical wall of the container and an annular curved wall connecting the toroidal standing ring and the support ring. The cup further includes a central disc that is connected by a cylindrical portion and an annular peripheral wall that extends upwardly along a portion of the bottom of the container.

It has been suggested that resistance to axial loads be controlled by preferential permanent deformation of certain portions of the base cup as shown in U.S. Pat. No. 3,927,782 but this obviously affects the appearance of the package.

Such a base cup has proved satisfactory but utilizes a large amount of material. The curved nature of the toroidal standing ring results in lesser stability and high stress concentration. Top load on the package transmitted downwardly is concentrated at the inner portion of the toroidal standing ring resulting in high stress concentration and large deformation. Furthermore, the use of a toroidal supporting ring results in the ring having a smaller diameter than the diameter of the bottle so that the bottle is less stable.

Furthermore, the diameter of the supporting ring is small as compared to the diameter of the bottle resulting in high stress in the bottom wall above the supporting ring.

Accordingly, among the objectives of the present invention are to provide a pressurized fluid package which utilizes a base design that obviates the aforementioned disadvantages and results in increased container stability, lesser stress concentration, increased resistance to top load, less tendency for the container to contact the supporting surface and utilizes a lesser amount of plastic material.

In accordance with the invention a pressurized fluid package comprises an oriented plastic bottle having a generally cylindrical side wall, a neck terminating in a finish or a closure at the upper end, and a hemispherical bottom wall. The base is made of plastic material and comprises a standing ring for engaging a support surface and having a generally planar contacting surface. The base includes a support ring spaced above said standing ring and having an annular surface engaging the hemispherical bottom wall. The base has an annular supporting member extending from the inner periphery of the standing ring and inclined upwardly and inwardly to the outer periphery of the supporting ring, the supporting member being more vertical than horizontal.

DESCRIPTION OF THE INVENTION

Figure 1:
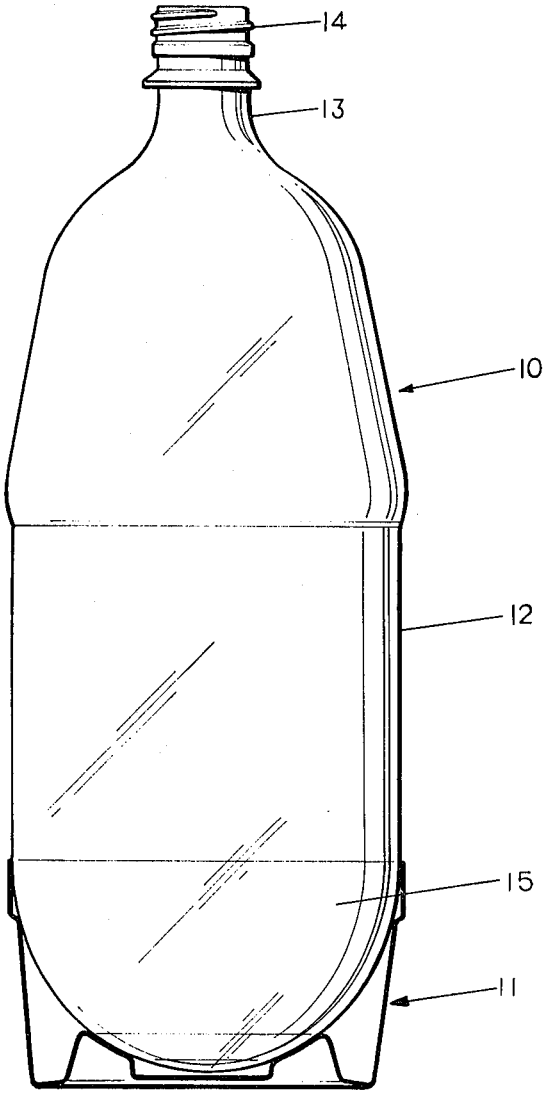
FIG. 1 is an elevational view of the pressurized fluid package embodying the invention with the bottle in full side view and the base cup in sectional view.

Referring to FIG. 1, the package for pressurized fluids such as carbonated beverages comprises a plastic container or bottle 10 and a plastic base 11. The container 10 is preferably made by well-known processes for forming oriented plastic containers from organic plastic material such as polyethylene terepthlate and comprises a cylindrical wall 12, a neck 13 and a finish 14 adapted to receive a closure. The bottle further includes a hemispherical bottom portion 15 which is well-known to provide optimum resistance to pressure.

Figure 2:
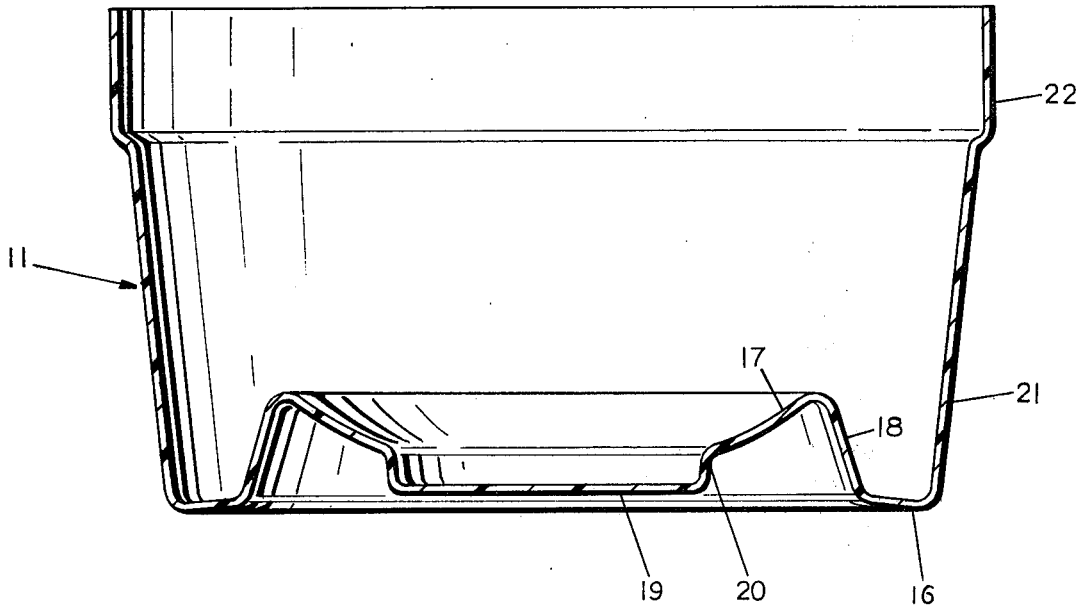
FIG. 2 is a vertical sectional view of the base cup of the package shown in FIG. 1.

Referring to FIG. 2, the base cup 11 includes an annular standing ring 16 that is adapted to engage a surface for supporting the package, a concave central supporting portion, including an annular support ring 17, that engages the outer surface of the hemispherical portion 15 of the container 10.

Figure 3:
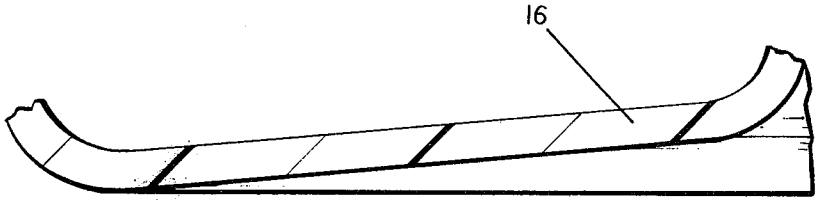
FIG. 3 is a fragmentary view on an enlarged scale of a portion of the bottom of the base cup shown in FIG. 2.

The standing ring 16 is generally flat or planar and is inclined upwardly and inwardly (FIG. 3) and connected by a small radius to the supporting portion of member 18. Supporting member 18 extends from the inner periphery of the standing ring 16 to the outer periphery of the supporting ring 17 and is connected to supporting ring 17 by a sharp radius. The supporting member 18 is frustoconical and more vertical than horizontal, preferably forming an angle of about 70° with the horizontal.

The base cup 11 further includes a disc 19 at the center which is connected by a cylindrical portion 20 to the inner periphery of the supporting ring 17.

In order to provide maximum stability, the outer periphery of the standing ring 16 first engages the supporting surface although, in use, after the container is filled, the standing ring 16 may be flexed into full contact with the supporting surface.

Figure 4:
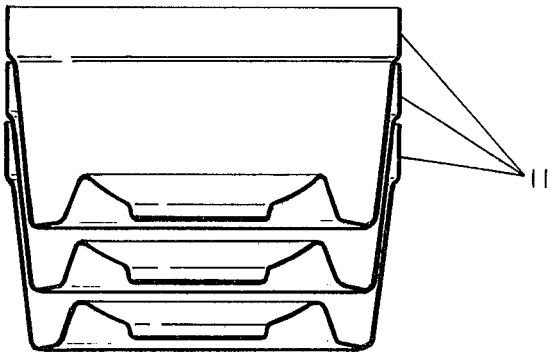
FIG. 4 is a sectional view through a stack of base cups.

In order to obtain further stability, the angle subtended by the outer periphery of the supporting ring 17 is maximized, that is, it is made as large as possible. The base 11 further includes a peripheral wall 21 that is generally vertical and extends along into engagement with the bottom of the container, primarily for aesthetic purposes. In order to facilitate handling of the base cups, a cylindrical portion 22 of greater diameter is provided at the upper end of the peripheral wall so that the base cups can be readily stacked and unstacked as shown in FIG. 4.

The base cup 11 is made of an organic plastic material such as polyethylene. The package is completed with the provision of adhesive on the supporting ring 17.

It has been found that the base cup provides improved container stability, improved top load strength, reduced base cup weight and reduced injection molding cycle time. The substantially uniform thickness of base cup reduces required injection molding cycle time. The upwardly and inwardly inclined planar standing ring with engagement with the supporting surface at its own outermost surface results in improved container stability especially during handling. The straight supporting member 18 with a steep angle improves the strength for top load. The increased diameter of the contact area between the support ring 17 and the bottom of the bottle improves the overall top load strength of the package.

The base cup embodying the invention differs from prior constructions as follows:

(1) A nearly flat or planar bottom panel instead of a torus structure is used for the standing ring 16, the bottom of which tilts upwardly and inwardly to enlarge the effective diameter of the standing ring to increase the container upright stability during filling and handling operations.

(2) The supporting member 18 connecting the standing ring 16 and the supporting ring 17 is nearly straight with a steep slope so that the stress caused by the top load is lessened.

(3) The steep slope of the supporting member 18 in conjunction with a small radius of curvature joining the member 18 to the supporting ring 17 permits the use of a larger diameter supporting ring 17 so that the stress in the bottom wall just above the ring 17 is reduced and strength against top load is increased.

(4) A clearance between the bottom center of the bottle and the base cup is provided to protect the bottle from making direct contact with supporting plane.

(5) A short cylindrical section, with bottom closed off, in the center bottom of the base cup provides additional support for top load.

The base cup preferably embodies the following relationships:

(1) Radii of curvature $\leqq 10\times$(wall thickness);
(2) (Angle between the supporting member 18 and horizontal plane)$>45°$;
(3) Outer diameter of support ring 17$>0.5\times$(Diameter of the main body of the bottle);
(4) (Outer diameter of standing ring 16)$>0.75$ (Diameter of the main body of the bottle);
(5) (Diameter of bottom circular disc 19)$<0.4\times$(Diameter of the main body of the bottle);
(6) Supporting member 18 is substantially straight in frustoconical shape.

Figure 5:
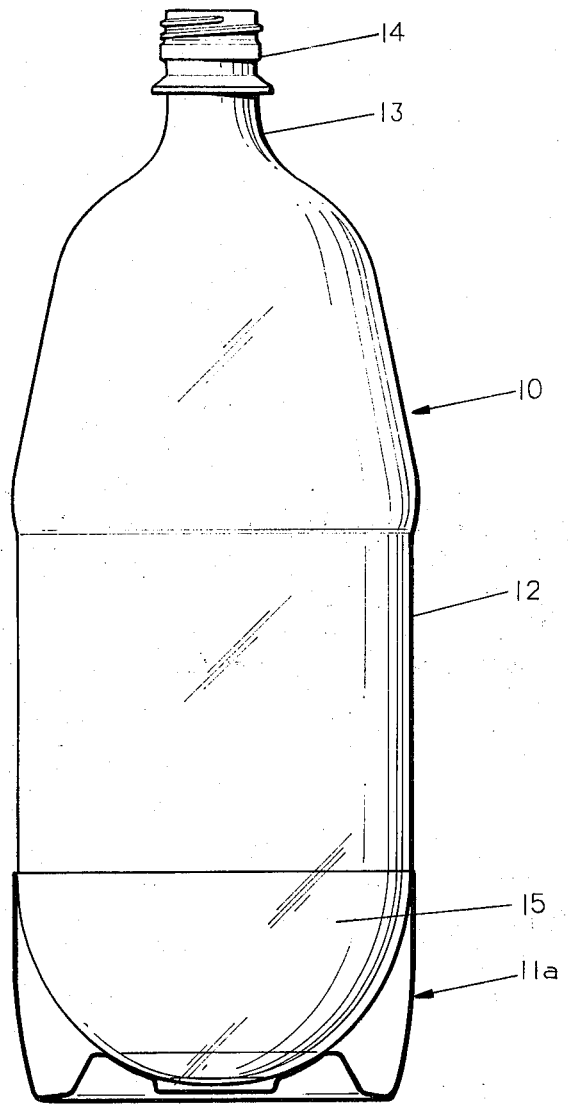
FIG. 5 is an elevational view of a modified form of pressurized fluid package with the bottle in full side view and the base cup in sectional view.
Figure 6:
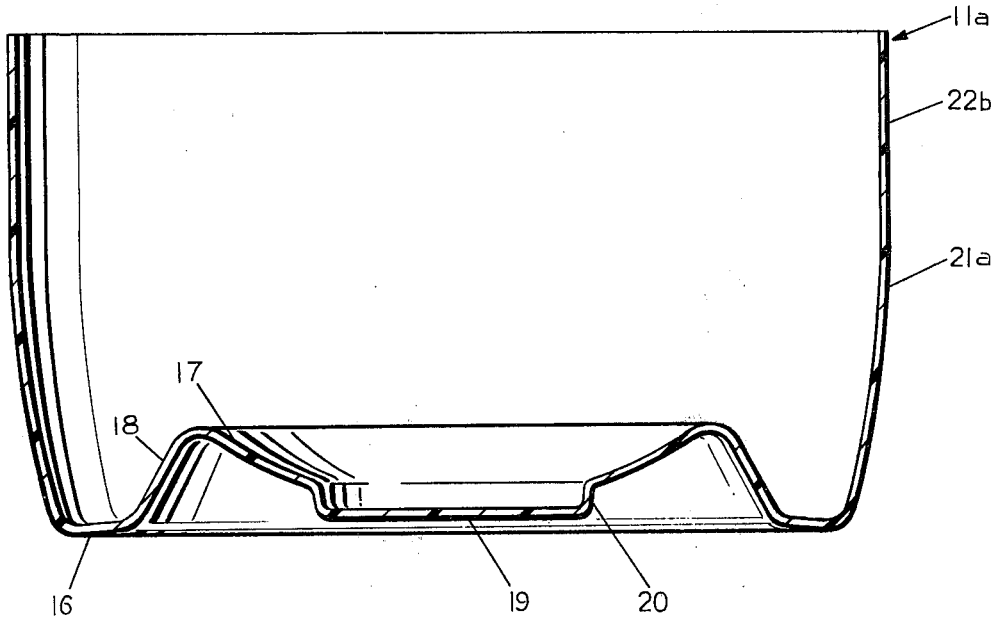
FIG. 6 is a vertical sectional view of the base cup of the package shown in FIG. 5.

In the form of the invention shown in FIGS. 5 and 6, the base cup 11*a* is substantially the same as the base cup 11 of FIGS. 1–4 except that the wall 21*a* curves outwardly from the periphery of the standing ring 16 and extends to an upper cylindrical configuration 22*b*.

Figure 7:
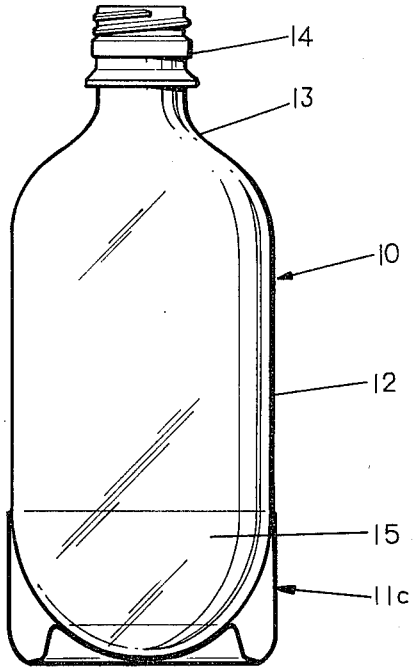
FIG. 7 is an elevational view of another modified form of pressurized fluid package with the bottle in full side view and the base cup in sectional view.
Figure 8:
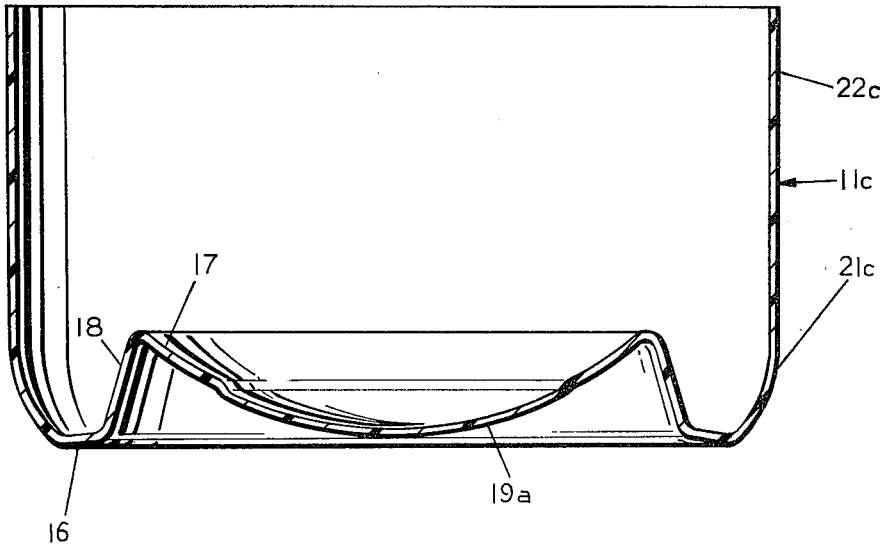
FIG. 8 is a vertical sectional view of the base cup of the package shown in FIG. 7.

In the form shown in FIGS. 7 and 8, the base cup 11*c*, has the central portion 19*a* shaped concave downwardly rather than cylindrical and the wall 21*c* curved sharply from the periphery of standing ring 16 to a cylindrical portion 22*c*. Such a cup 11*c* is satisfactory for smaller plastic bottles on the order of one-half liter capacity.

While in the preferred embodiment the fluid package contains pressurized fluids, such as carbonated beverages, the package and base cup may be used with non-pressurized contents. Similarly, while in the preferred embodiment the plastic container is molecularly oriented, unoriented containers may be used for some purposes where the increased physical properties due to orientation are not required.

I claim:

1. A pressurized fluid package comprising:

an oriented plastic bottle having a main body that includes a generally cylindrical side wall, a neck terminating in a neck finish on the upper end of the neck for receiving a closure, a hemispherical bottom wall in which the radius of the hemisphere forming the bottom wall is substantially equal to the radius of the main body, a base of plastic material comprising a standing ring for engaging a support surface, said base adapted for injection molding with a reduced molding cycle time, said base being of substantially uniform wall thickness, said standing ring being so constructed and arranged that it has a generally planar contacting surface for substantially full contact with the supporting surface for greater stability, said base including a support ring spaced above said standing ring, the support ring being so constructed and arranged that it has substantially full contact with the bottom of the bottle, said base having an annular supporting member extending from the inner periphery of the standing ring and inclined upwardly and inwardly to the outer periphery of the support ring, the base initially engaging a support surface along the outer edge of the standing ring, the standing ring flexing into substantially full contact with the support surface when the bottle is filled and pressurized, said annular supporting member being so constructed and arranged that it is substantially straight in frusto-conical shape and the member remaining straight when the bottle is filled and pressurized to provide the package with improved stability and improved strength against top load stress.

2. The pressurized fluid package set forth in claim 1 in which the supporting member is at an angle of about 70° with the horizontal.

3. The pressurized fluid package set forth in claim 1 wherein said base includes a generally downwardly extending cylindrical portion extending from the inner periphery of the support ring and a planar horizontal portion forming a bottom circular disc extending from the lower end of the cylindrical portion and closing the bottom of the base.

4. The pressurized fluid package set forth in claim 3 in which the supporting member is at an angle of about 70° with the horizontal.

5. The pressurized fluid package set forth in claim 1 wherein the angle between the annular supporting member and a horizontal plane is greater than 45°.

6. The pressurized fluid package set forth in claim 1 wherein the outer diameter of the support ring is greater than 0.5 times the diameter of the main body of the bottle.

7. The pressurized fluid package set forth in claim 1 wherein the outer diameter of the standing ring is greater than 0.75 times the diameter of the main body of the bottle.

8. The pressurized fluid package set forth in claim 3 wherein the diameter of the bottom circular disc is less than 0.4 times the diameter of the main body of the bottle.

9. The pressurized fluid package set forth in claim 1 wherein an outer upper edge of the peripheral wall of the base includes a portion of greater diameter providing for stacking of one base within another.

10. A base for a pressurized fluid package comprising an oriented plastic bottle having a main body including a generally cylindrical side wall, a neck terminating in a neck finish on the upper end of the neck for receiving a closure and a hemispherical bottom wall in which the radius of the hemisphere forming the hemispherical bottom wall is about equal to the radius of the main body, said base being made of plastic material and including a standing ring for engaging a support surface, said standing ring having a generally planar contacting surface for flexing into full contact with the support surface when the bottle is filled, the base initially engaging a support surface along the outer edge of the standing ring, the standing ring flexing into substantially full contact with the support surface when the bottle is filled and pressurized, said base including a support ring spaced above said standing ring and having an annular surface engaging the hemispherical bottom wall, said base having an annular supporting member extending from the inner periphery of the standing ring and inclined upwardly and inwardly to the other periphery of the support ring, the support member being at an angle of about 70° to the horizontal, said annular support member being substantially straight in frusto-conical shape.

11. The base set forth in claim 10 wherein the outer diameter of the standing ring is greater than 0.75 times the diameter of the main body of the bottle.

12. The base set forth in claim 10 wherein the support ring is integrally connected to an inner bottom circular disc, the inner periphery of the support ring defining the outer periphery of the circular disc and wherein the diameter of the bottom circular disc is less than 0.4 times the diameter of the main body of the bottle.

13. The base set forth in claim 10 wherein the base has an upper edge with a peripheral wall that includes a portion of greater diameter providing for stacking of one base within another.

14. A base for a pressurized fluid package comprising an oriented plastic bottle having a generally cylindrical sidewall, a neck terminating in a neck finish on the upper end of the neck for receiving a closure, and a hemispherical bottom wall, said base being made of plastic material and including a standing ring for engaging a support surface, said standing ring having a generally planar contacting surface for flexing into full contact with the support surface when the bottle is filled, the base initially engaging a support surface along the outer edge of the standing ring, the standing ring flexing into substantially full contact with the support surface when the bottle is filled and pressurized, said base including a support ring spaced above said standing ring and having an annular surface engaging the hemispherical bottom wall, said base having an annular supporting member extending from the inner periphery of the standing ring and inclined upwardly and inwardly to the outer periphery of the support ring and wherein;

(a) the angle between the annular supporting member and the support surface is about 70°;

(b) the outer diameter of the support ring is greater than 0.5 times the diameter of the main cylindrical side wall of the bottle;

(c) the outer diameter of the standing ring is greater than 0.75 times the diameter of the main cylindrical side wall of the bottle; and (d) the annular supporting member is a substantially straight frustoconical shape and remains straight when the bottle is filled.

* * * * *